US008558199B2

(12) United States Patent
Payeur et al.

(10) Patent No.: US 8,558,199 B2
(45) Date of Patent: Oct. 15, 2013

(54) ALL-OPTICAL METHOD AND SYSTEM FOR GENERATING ULTRASHORT CHARGED PARTICLE BEAM

(71) Applicant: Institut National de la Recherche Scientifique, Quebec, CA (US)

(72) Inventors: Stephane Payeur, Montreal (CA); Sylvain Fourmaux, Montreal (CA); Jean-Claude Kieffer, Montreal (CA); Michel Piche, Quebec (CA); Jean-Philippe MacLean, Saint-Lambert (CA); Christopher Tchervenkov, Brossard (CA)

(73) Assignee: Institut National de la Recherche Scientifique (INRS), Quebec (CA)

( * ) Notice: Subject to any disclaimer, the term of this patent is extended or adjusted under 35 U.S.C. 154(b) by 0 days.

(21) Appl. No.: 13/724,379

(22) Filed: Dec. 21, 2012

(65) Prior Publication Data

US 2013/0161539 A1 Jun. 27, 2013

Related U.S. Application Data

(60) Provisional application No. 61/579,727, filed on Dec. 23, 2011.

(51) Int. Cl.
*G21G 4/00* (2006.01)

(52) U.S. Cl.
CPC ..... *G21G 4/00* (2013.01)
USPC ..... 250/493.1

(58) Field of Classification Search
USPC ..... 250/493.1, 423 R
See application file for complete search history.

(56) References Cited

U.S. PATENT DOCUMENTS

2009/0128906 A1* 5/2009 Stiens et al. ..... 359/487

OTHER PUBLICATIONS

Varin C. and Piché M., Relativistic attosecond electron pulses from a free-space laser-acceleration scheme, Phys. Rev. E 74 045602 (2006).
Karmakar A. and Pukhov A., Collimated attosecond gev electron bunches from ionization of high-Z material by radially polarized ultra-relativistic laser pulses, Laser Part. Beams 25 371-7 (2007).
P. L. Fortin, M. Piche and C. Varin, Direct-field electron acceleration with ultrafast radially polarized laser beams: scaling laws and optimization J. Phys. B 43, 025401(2010).
Varin C., Piché M. and Porras M. A., Acceleration of electrons from rest to GeV energies by ultrashort transverse magnetic laser pulses in free space Phys. Rev. E 71 026603 (2005).
Salamin Y. I., Mono-energetic GeV electrons from ionization in a radially polarized laser beam Opt. Lett. 32 90-2 (2007).
Kong Q., Miyazaki S., Kawata S., Miyauchi K., Sakai K., Ho Y K. Nakajima K., Miyanaga N., Limpouch J. and Andreev A. A., Electron bunch trapping and compression by an intense focused pulse laser Phys. Rev. E 69. 056502 (2004).
K.P. Singh and M. Kumar, Electron acceleration by a radially polarized laser pulse during ionization of low density gases, Phys. Rev. ST Accel. Beams 14, 030401 (2011).

(Continued)

*Primary Examiner* — Kiet T Nguyen
(74) *Attorney, Agent, or Firm* — Goudreau Gage Dubuc; Gwendoline Bruneau

(57) ABSTRACT

A method for generating an ultrashort charged particle beam, comprising creating a high intensity longitudinal E-field by shaping and tightly focusing, in an on-axis geometry, a substantially radially polarized laser beam, and using the high intensity longitudinal E-field for interaction with a medium to accelerate charged particles.

26 Claims, 17 Drawing Sheets

(56) References Cited

OTHER PUBLICATIONS

Salamin Y. I., Electron acceleration from rest in vacuum by an axicon Gaussian laser beam Phys. Rev. A 73, 043402 (2006).

D.N. Gupta, N. Kant, D.E. Kim, and H. Suk, Electron acceleration to GeV energy by a radially polarized laser. Phys. Lett. A 368, 402 (2007).

L. J. Wong and F. X. Kartner, Opt. Express 18, 25035 (2010).

S. G. Bochkarev, K. I. Popov and V. Yu. Bychenkov, Vacuum Electron Acceleration by a Tightly Focused, Radially Polarized, Relativistically Strong Laser Pulse, Plasma Physics reports, vol. 37, No. 7, 603-614 (2011).

12. Malav, Maheshwari and Senecha, Analytical and numerical investigation of the effect of pulse shape of intense, few-cycle TM01 laser on the acceleration of charged particles, Indian Journ. of pure and Appl. Physics, vol. 49, 251-256 (2011).

13. Alexandre April, Michel Piché, 4π Focusing of TM01 beams under nonparaxial conditions, Optics Express, vol. 18, No. 21, 22128 (2010).

14. Liang Jie Wong, Franz X. Kärtner, Optics Letters. vol. 36, No. 6, 957 (2011).

15. E. Esarey, P. Sprangle, J. Krall, Phys. Rev. E, vol. 52, No. 5, 5443, (1995).

16. Y. Liu, D. Cline, P. He, Vacuum laser acceleration using a radially polarized CO2 laser beam, Nuclear Instruments and Methods in Physics Research A 424, 296-303 (1999).

* cited by examiner

550uJ, 15-17 fs, 1,8μm, Camera SI-1000 4um Al, 250um EJ-212

550uJ, 15-17 fs, 1.8 μm, Camera SI-1000 4um Al, 250um EJ-212

ALL-OPTICAL METHOD AND SYSTEM FOR GENERATING ULTRASHORT CHARGED PARTICLE BEAM

CROSS REFERENCE TO RELATED APPLICATIONS

This application claims benefit of U.S. provisional application Ser. No. 61/579,727, filed on Dec. 23, 2011. All documents above are incorporated herein in their entirety by reference.

FIELD OF THE INVENTION

The present invention relates to the generation of ultrashort charged particle beam. More specifically, the present invention is concerned with an all-optical method and system for generating ultrashort charged particle beam.

BACKGROUND OF THE INVENTION

Production of ultrashort electron bunches is needed in a number of applications, ranging from time-resolved electron microscopy to free-electron laser injection.

An ultrashort electron beam can be generated by many methods, including for example direct field vacuum acceleration, Wakefield acceleration and high power longitudinal field acceleration.

Theoretical studies on high power longitudinal field acceleration suggest using a radially polarized laser beam from an extremely high power laser system, i.e. in the Petawatt range. The power threshold for acceleration is related to the following equation, in Terawatts (TW), where e and $m_e$ are respectively the electron charge and mass, $\eta_0$ is the impedance of free space, $\lambda_0$ is the central laser wavelength, $\omega_0$ is central laser frequency:

$$P_{seuil} = \frac{\pi^5}{2\eta_0}\left(\frac{\omega_0}{\lambda_0}\right)^4\left(\frac{m_e c^2}{e}\right)^2 \simeq \frac{1}{10}\left(\frac{\omega_0}{\lambda_0}\right)^4 TW.$$

Such method uses a long focal length configuration, i.e. low numerical aperture (NA), and requires high power systems (Petawatt level systems). Moreover, it requires a carrier envelope phase (CEP) stable laser pulse for stable electron beam. Stable CEP Petawatt laser systems are not currently available.

There is still a need in the art for an all-optical method and system for generating ultrashort charged particle beam.

SUMMARY OF THE INVENTION

More specifically, in accordance with the present invention, there is provided a method for generating an ultrashort charged particle beam, comprising creating a high intensity longitudinal E-field by shaping and tightly focusing, in an on-axis geometry, a substantially radially polarized laser beam, and using the high intensity longitudinal E-field for interaction with a medium to accelerate charged particles.

There is further provided a system for generating ultrashort charged particle beam, in an interaction chamber, comprising a laser system delivering an ultrashort pulse; a polarization converter unit converting a beam from the laser system into a substantially radially polarized laser beam; amplitude beam shaping and transport optics shaping the radially polarized laser beam; focusing optics tight-focusing the beam received from the transport optics in an on-axis geometry; and a first medium from which charged particles are accelerated by the tight-focused beam.

There is further provided a method, comprising a) radially polarizing, shaping and optimizing a high peak power laser pulse; and b) tight focusing the radially polarized pulse in an on-axis geometry, in a low pressure gas environment, thereby generating a high intensity longitudinal E-field.

There is further provided a method for generating X ray or particles sources, comprising creating a high intensity longitudinal E-field by tightly focusing a radially polarized laser beam in an on-axis geometry, using the high intensity longitudinal E-field for interaction with a first medium to accelerate charged particles and generate an ultrashort charged particle beam, and interacting the ultrashort charged particle beam with a second medium located close to the acceleration region.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings:

FIG. 16 shows a system to accelerate particle in a cascaded way according to an embodiment of an aspect of the present invention;

DESCRIPTION OF EMBODIMENTS OF THE INVENTION

Figure 1:
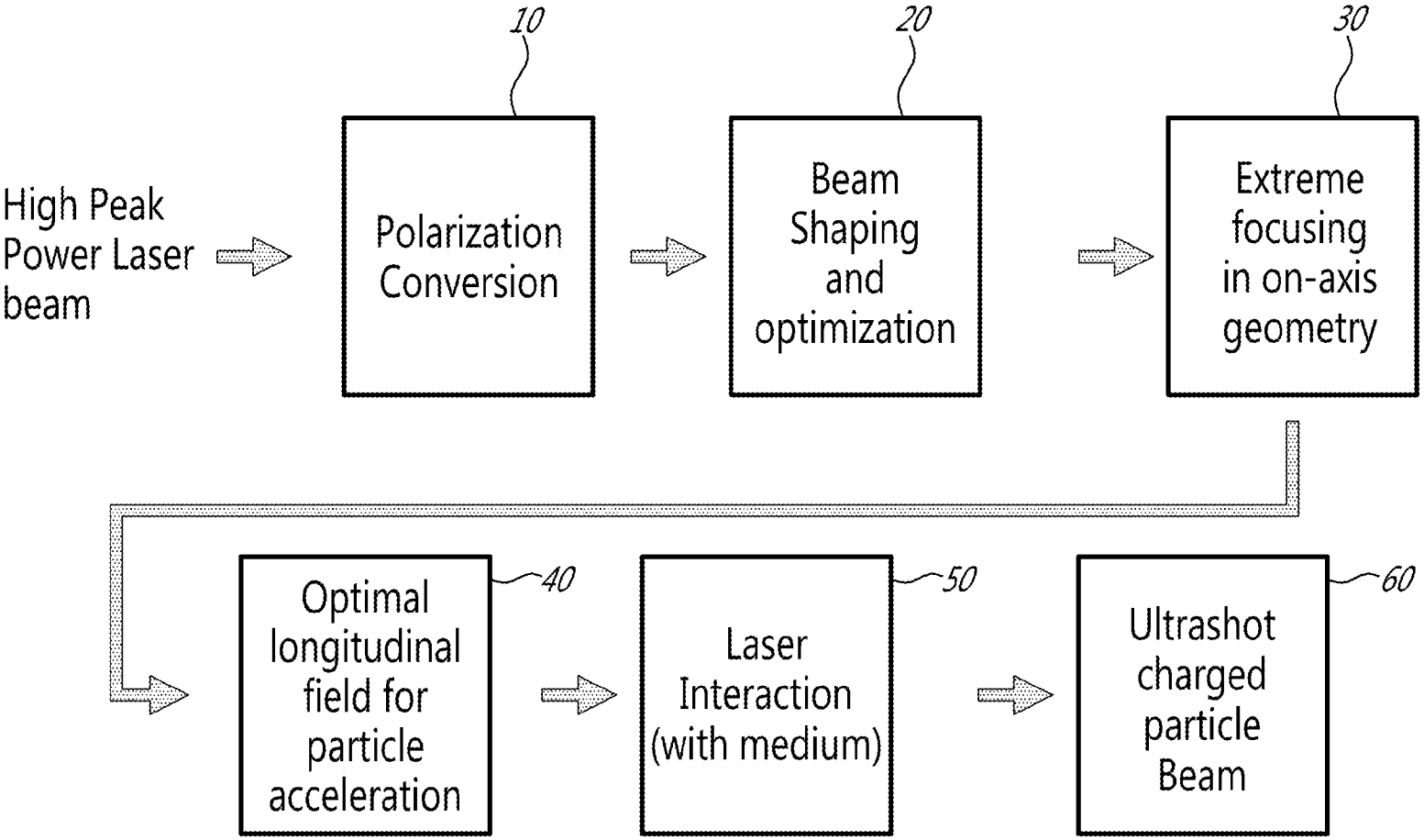
FIG. 1 is a flowchart of a method according to an embodiment of an aspect of the present invention.

As illustrated in FIG. 1, a method according to an embodiment of an aspect of the present invention comprises creating a high intensity E-field by selecting optical elements to substantially radially polarize (step 10), shape and optimize (step 20) the beam from a high peak power laser, then tightly focus the beam in an on-axis geometry (step 30). Steps 10, 20 and 30 may be performed in any order, i.e. step 10 may be performed after of prior to step 20 and coatings of the focusing optics used in step 30 may be provided for selectively reflecting target parts of the beam for example. The high intensity E-field thus produced by superposition of the different field components of the radially polarized laser beam in a constructive way at the focus (step 40) is used for interaction with a medium (step 50) to accelerate charged particles and generate an ultrashort charged particle beam (step 60).

The method uses all optical elements, and therefore does not require using anode or cathode. The optical elements are selected to create a high intensity E-field able to accelerate charged particles. The E-field is created by tightly focusing a substantially radially polarized laser beam ($TM_{01}$ mode) with a numerical aperture (NA) optic of at least 0.5. Contrary to a linearly polarised beam ($TEM_{00}$ mode), in which the total longitudinal component of the electric field is close to zero at the focus, the different electric field components of the radially polarized laser beam ($TM_{01}$ beam) superpose in a constructive way along the propagation axis. At high intensities, the longitudinal electric field component can accelerate the electrons located in the focal region along the propagation axis, while the transverse field components (electric and magnetic) help maintain the particles close to the beam propagation axis. The intensity of the resulting longitudinal field is dependent upon the peak power of the pulse, and the numerical aperture (NA) of the focusing optics.

It was shown by theoretical work that under tight focusing conditions such as those obtained with a high-aperture parabolic mirror, charged particles initially at rest on the optical axis may be accelerated to mega-electron-volt energies at peak powers as low as 10 GW with few-cycle pulses. It was shown that at higher peak powers, the use of shorter pulses yields a more efficient acceleration.

Figure 2:
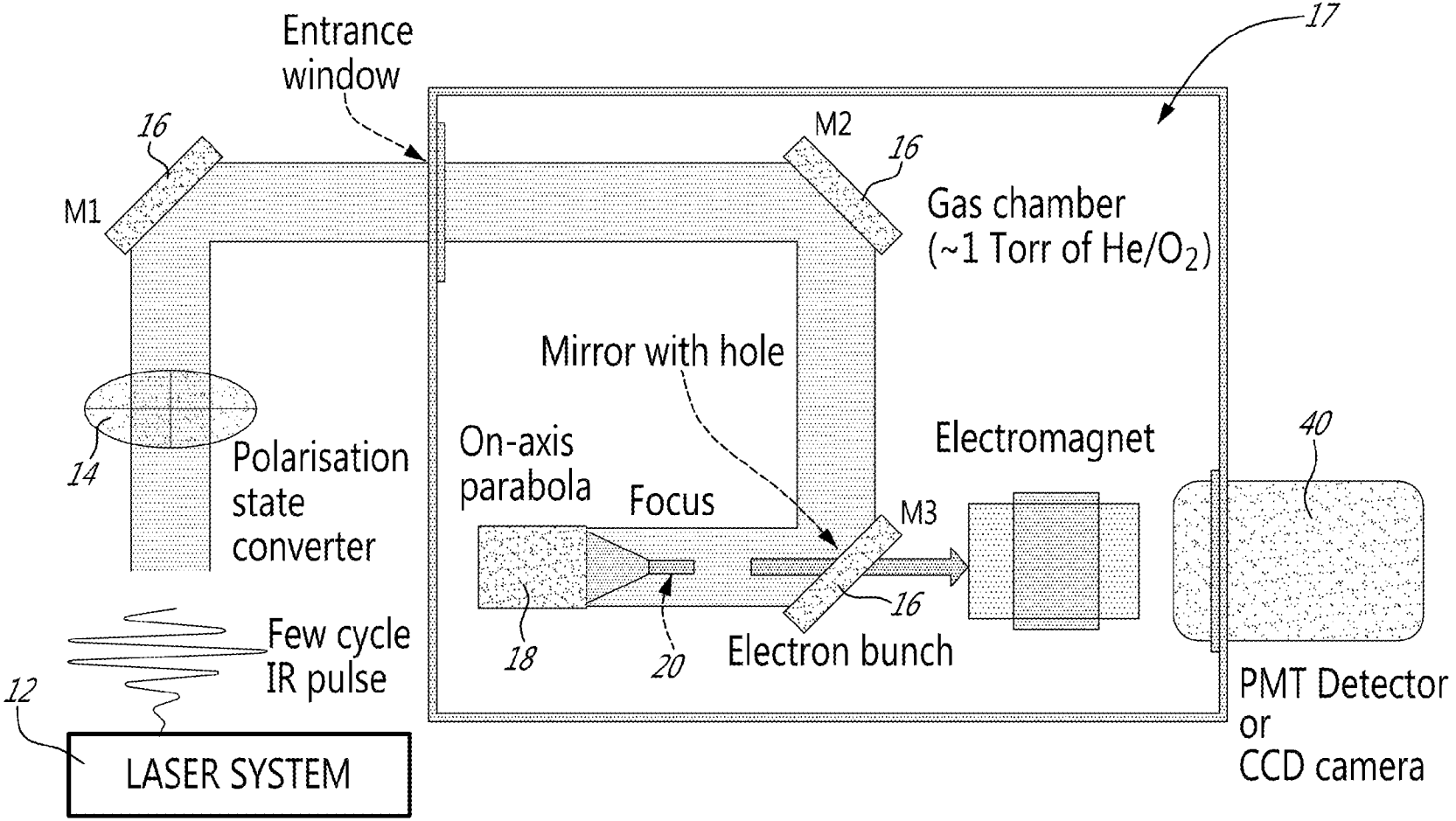
FIG. 2 is a diagrammatic view of a system according to an embodiment of an aspect of the present invention.

A system according to an embodiment of an aspect of the present invention, illustrated for example in FIG. 2, comprises a laser system 12 emitting a high peak power laser beam, a polarization state converter unit 14, amplitude beam shaping and transport optics 16, focusing optics 18 and a medium 20 from which charged particles are accelerated, in an interaction chamber 17. The focusing optics 18 is selected to compatible with ultrashort pulses so as to avoid non-linear effect affecting the pulse. In FIG. 2, a photo-multiplier tube (PMT) detector or CDD camera 40 is used to detect the charged particles.

The laser system 12 delivers ultrashort pulse, i.e. of the order of picoseconds, femtoseconds or attoseconds. It may be a high peak power ultrashort laser pulse, such as a few cycle IR pulse laser for example, or fiber lasers or ultrashort pulse parametric amplifiers.

Figure 3A:
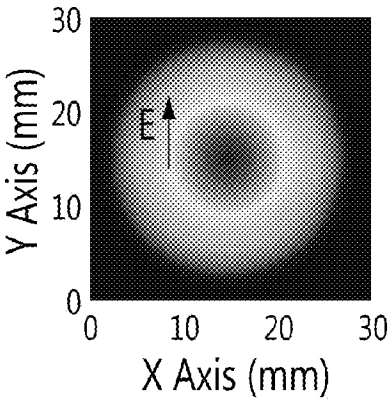
FIG. 3 show: a) an input beam on a polarization state converter shown in b) composed of waveplate sections of specifically oriented fast axis, and c) the output beam of the polarization state converter, in near field.
Figure 3B:
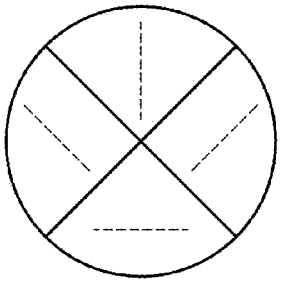
Figure 3C:
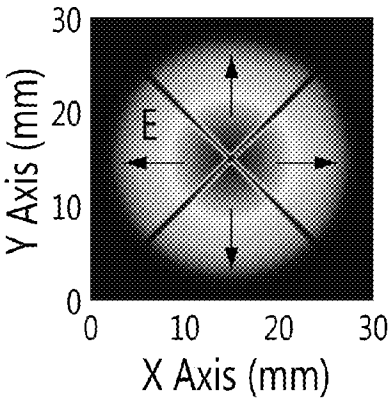
Figure 4:
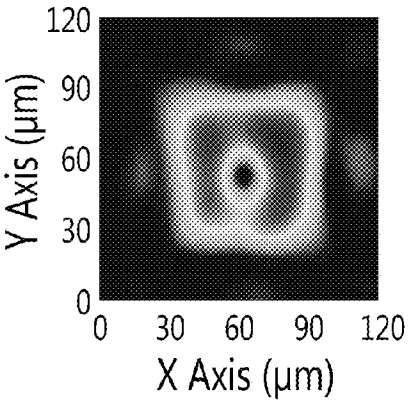
FIG. 4 shows an image of a beam as measured in the focal plane of a low NA optic after the polarization state converter.

The polarization converter unit 14 may consist of achromatic half wave plates, between 1 to 16 sections for example, used to convert the polarization of the beam emitted by the laser system 12 to a substantially radially polarization, i.e. from $TEM_{00}$ to a $TM_{01}$ or a $TE_{01}$ mode. FIG. 3 show that a theoretical vertically polarized Gaussian beam (FIG. 3*a*) is converted by a four section polarization converter (FIG. 3*b*: the dotted lines represent the axis of the plates) into a radially Gaussian beam (FIG. 3*c*). FIG. 4 shows an image of a beam as measured in the focal plane of a low NA optic after the polarization state converter.

Alternatively, in step 10 of FIG. 1, other polarization converters could be used, such as for example electro optical modulators, Z-polarization plates, mode polarization combinators or fiber optics.

Figure 5A:
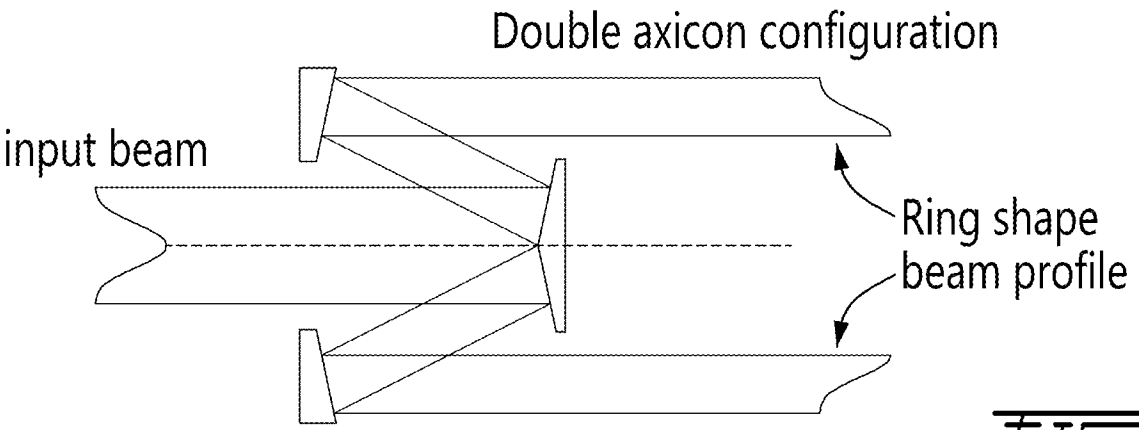
FIG. 5 show beam shaping and transport optics used in a system according to an embodiment of an aspect of the present invention: a) double axicon configuration and b) V-groove axicon configuration.
Figure 5B:
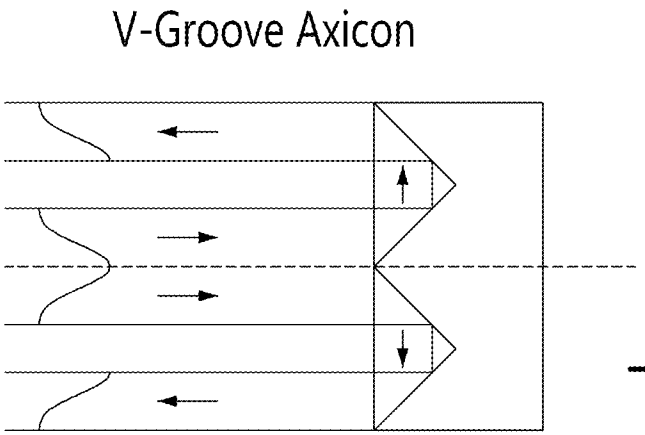

The amplitude beam shaping and transport optical elements 16 are used to shape the distribution of the intensity profile of the $TM_{01}$, into a ring shape distribution for example, so that upon focusing by the focusing optic 18 the longitudinal field component be optimized, and to propagate the beam to focusing optics 18 (see step 20 of FIG. 1). Transport optics are shown in FIG. 2 as high reflectivity mirrors M1, M2 and M3, with a hole machined in M3 to allow electrons detection. A double axicon configuration, such as illustrated for example in FIG. 5*a*, or a V-groove axicon configuration, such as illustrated for example in FIG. 5*b*, can be used. Alternatively, a hole mirror, an amplitude mask, a diffraction element or fiber optics could be used. All these optical elements can also be used in combination with a deformable mirror to correct and optimize the optical wavefront of the laser beam.

The interaction chamber 17 is filled with a low density gas such as helium, oxygen or argon. Alternatively any other gas medium, including mixtures of 2 or more gases, can be used in such a way that the longitudinal field can interact with charged particles. The maximum gas density limit is determined by the amount of non-linear effects on the propagating pulse that would significantly reduce of the laser-matter interaction efficiency.

Figures 6A, 6B, 6C:
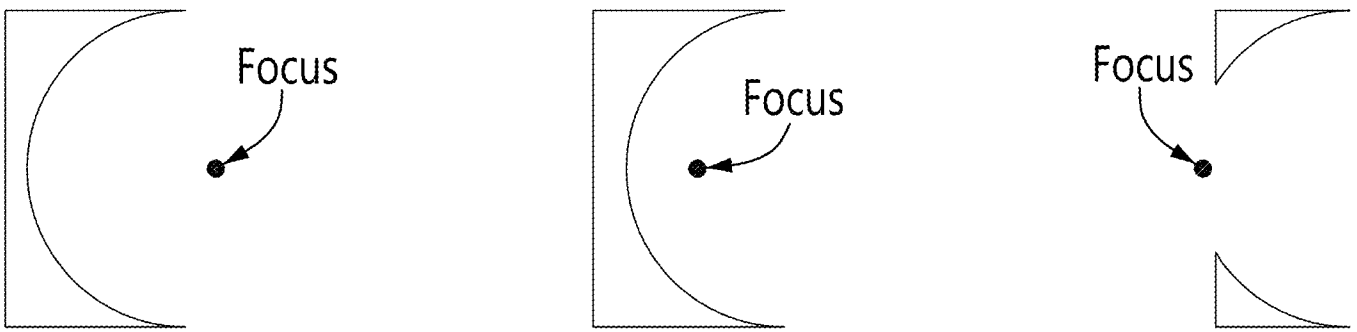
FIG. 6 illustrate focusing optics using a parabolic mirror, according to an embodiment of an aspect of the present invention: a) focus near the edge of the parabola; b) inside the parabolic mirror; c) through the parabolic mirror.

The focusing optic 18 is used to focus the beam into a very small spot size in on-axis geometry (see step 30 in FIG. 1). It comprises high numerical aperture (NA) optics, i.e. NA of at least 0.5, compatible with ultrashort pulses as mentioned hereinabove. A parabolic mirror may be used in an on axis-geometry as illustrated for example in FIG. 6, with a focal point position near or at the edge of the parabola (FIG. 6*a*), inside the parabola (FIG. 6*b*) or through a partially cut parabolic mirror (FIG. 6*c*). Alternatively, a microscopic objective, a parabola/ellipsoid combination or a microscopic objective/ellipsoid combination could be used. All these optical elements can also be used with a deformable mirror to correct and optimize the optical wavefront of the transported/shaped/focused laser beam.

The particles beam is thus generated in the medium 20 where the longitudinal E-field is created. The particles thus generated propagate in a collimated way on the axis of the laser beam, the beam diverging quickly due the strong focusing before the focal plane.

The medium 20 in which charged particles are accelerated may be a gas, a liquid, a solid, including thin foil and clusters, or a plasma.

A substantially radially polarized beam is thus focused (step 30 in FIG. 1) so that the radial field projections cancel themselves transversally and align themselves longitudinally, in such a way that the longitudinal to transverse field ratio (LTFR) in the focal plane is maximum for an ultrashort pulse. In other words, the combination of the amplitude beam shaping and the focusing optics produce a high LTFR ratio, defined as follows:

$$LTFR = \frac{\text{Longitudinal Field intensity}}{\text{Transverse Field intensity}}.$$

Electron beam generation by longitudinal field acceleration from the laser pulse is then optimal.

Experiments were carried out using the Advanced Laser Light Source, Québec, Canada (ALLS) few-cycle infrared (IR) beamline. The source provided a 1 mJ, 15 fs pulse, centered at 1.8 μm with a repetition rate of 100 Hz. The energy stability of the pulse was approximately 2.5% rms. The laser pulse passed through a polarization state converter composed of four sections of IR achromatic half-wave plates (see FIG. 3*b*) with the fast axis orientation of 0° (top), +45° (right), 90° (bottom), −45° (left), which transformed a linearly polarized $TEM_{00}$ mode into a radially polarized mode $TM_{01}$. Transport optics then brought the pulse to an on-axis parabola in an interaction chamber filled with oxygen and in which the pressure could be varied from 2.5 mTorr to 100 Torr. An on-axis aluminum parabola 18 with a numerical aperture (NA) of 0.7 was used to tightly focus the laser pulse. The focused pulse ionized electrons from the oxygen atoms which were accelerated towards the detection system 40. The measurement was achieved through a hole machined in the last mirror M3 reflecting the laser beam to the on-axis parabola 18. For high sensitivity, the electron signal was measured with a scintillator coupled to a photo-multiplier tube (PMT) 40. The scintillator used was a particle sensitive plastic scintillator with a thin aluminum overcoat to avoid light detection, and it was coupled to a high dynamic range (16 bits) CCD camera located at 93 mm from the focus of the parabola 18.

The longitudinal field was thus generated by focusing a radially polarized $TM_{01}$ ultrashort laser pulse with a high numerical aperture parabola. The created longitudinal field had enough intensity to ionize and accelerate electrons from helium, oxygen and argon molecules in a low pressure gas environment, as discussed hereinabove.

Characterization of the focal spot at high intensity is not possible by conventional methods due to the high numerical aperture and on-axis geometry of the focusing parabola. Local surface quality of the parabola 18 (diameter of 8 mm) had been tested to be better than $\lambda/4$ at 675 nm with a laser diode source and performances have been extrapolated to 1.8 μm. The energy after the parabola was measured to be 550 μJ per pulse and the beam waist size was estimated to be $w_0 \approx 0.6\lambda$, giving a beam intensity of $7.4\times10^{17}$ W/cm$^2$. This corresponds to a normalized intensity of $a_z^2 \approx 2$ in the paraxial approximation.

Figure 7:
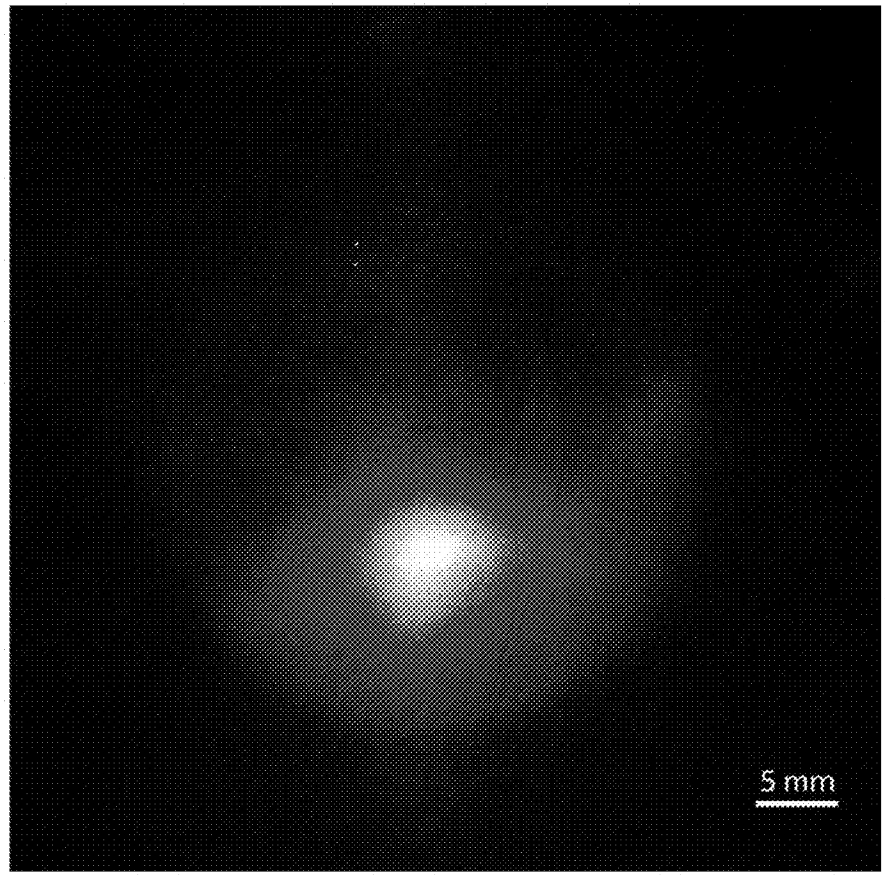
FIG. 7 shows a generated electron beam detected through the hole of the reflecting mirror M3 of the system of FIG. 2.

FIG. 7 shows a generated electron beam detected through the hole of the reflecting mirror M3 of the system of FIG. 2 by the electron camera detector 40. This shows the generated electrons propagate in a collimated beam.

The intensity of the longitudinal field at focus can be controlled by rotating the linear polarization before the polarization state converter 14 with the help of a half-wave plate. With a vertical input polarization, the output mode of the polarization state converter 14 had a radial polarization (simulated $TM_{01}$ mode) with a maximum longitudinal field at the focus. With a horizontal input polarization the output beam had an azimuthal polarization (simulated $TE_{01}$ mode) with no longitudinal field at the focus (see FIG. 8).

Figure 8:
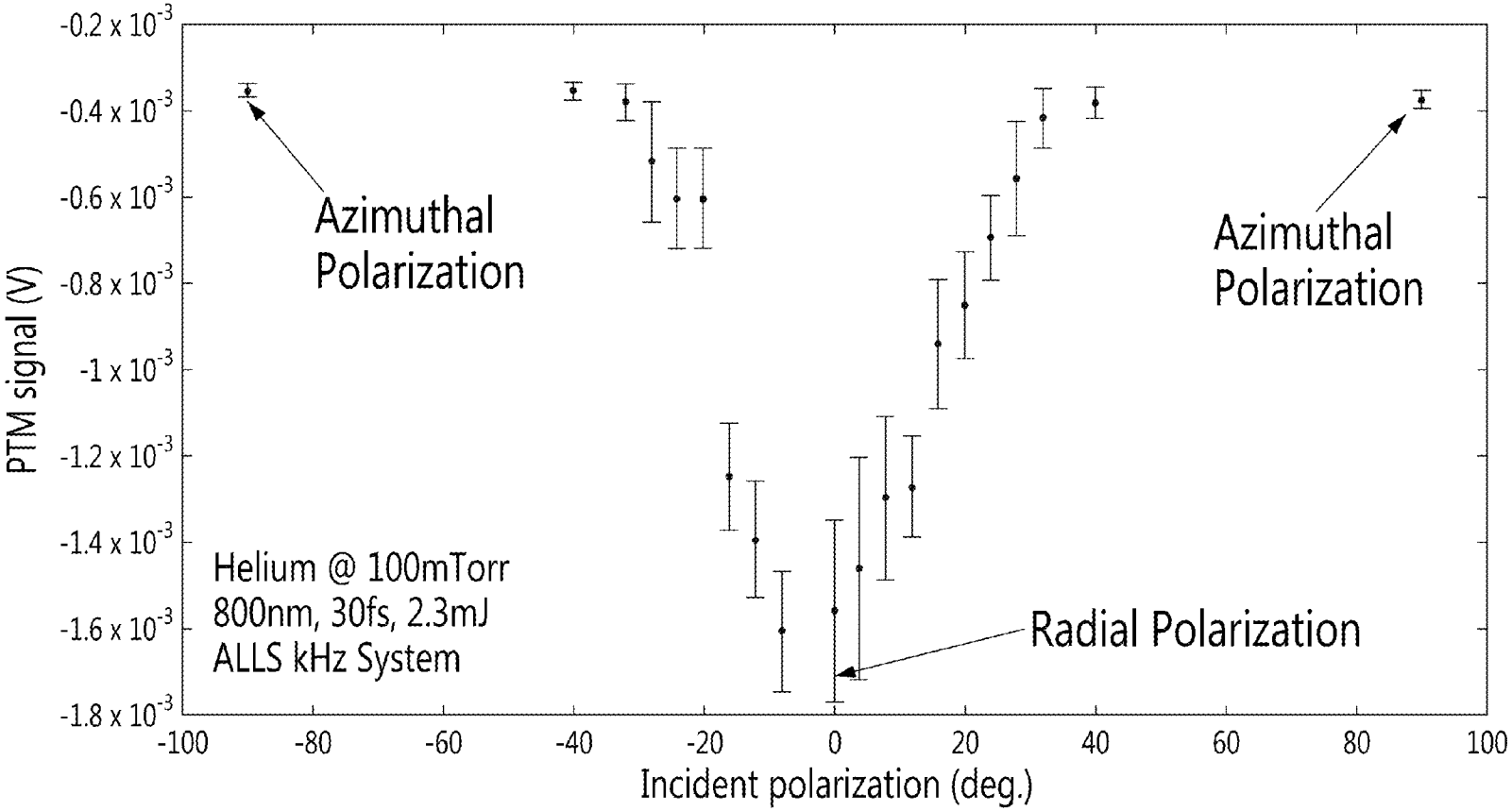
FIG. 8 shows experimental results of the dependence of the signal from the particle detector with respect to the longitudinal field strength at 800 nm, with Helium at 100 mTorr, 30 fs, 2.3 mJ, Advanced Laser Light Source (ALLS) kHZ system.

FIG. 8 shows this polarization dependence, by showing the observed electron signal measured by the PMT while shifting from azimuthal ($TE_{01}$ at −90 and 90 deg) polarisation mode with a purely transverse electric field to a radial ($TM_{01}$ at 0 deg) mode with a strong longitudinal electric field. This shows that maximum electron acceleration toward the propagation axis is generated with the $TM_{01}$ mode. No signal was observed when removing the polarization state converter ($TEM_{00}$ mode). The laser-matter interaction described in FIG. 8 was done with a 2.3 mJ, 30 fs pulses at 800 nm in 100 mTorr of helium.

Figure 9:
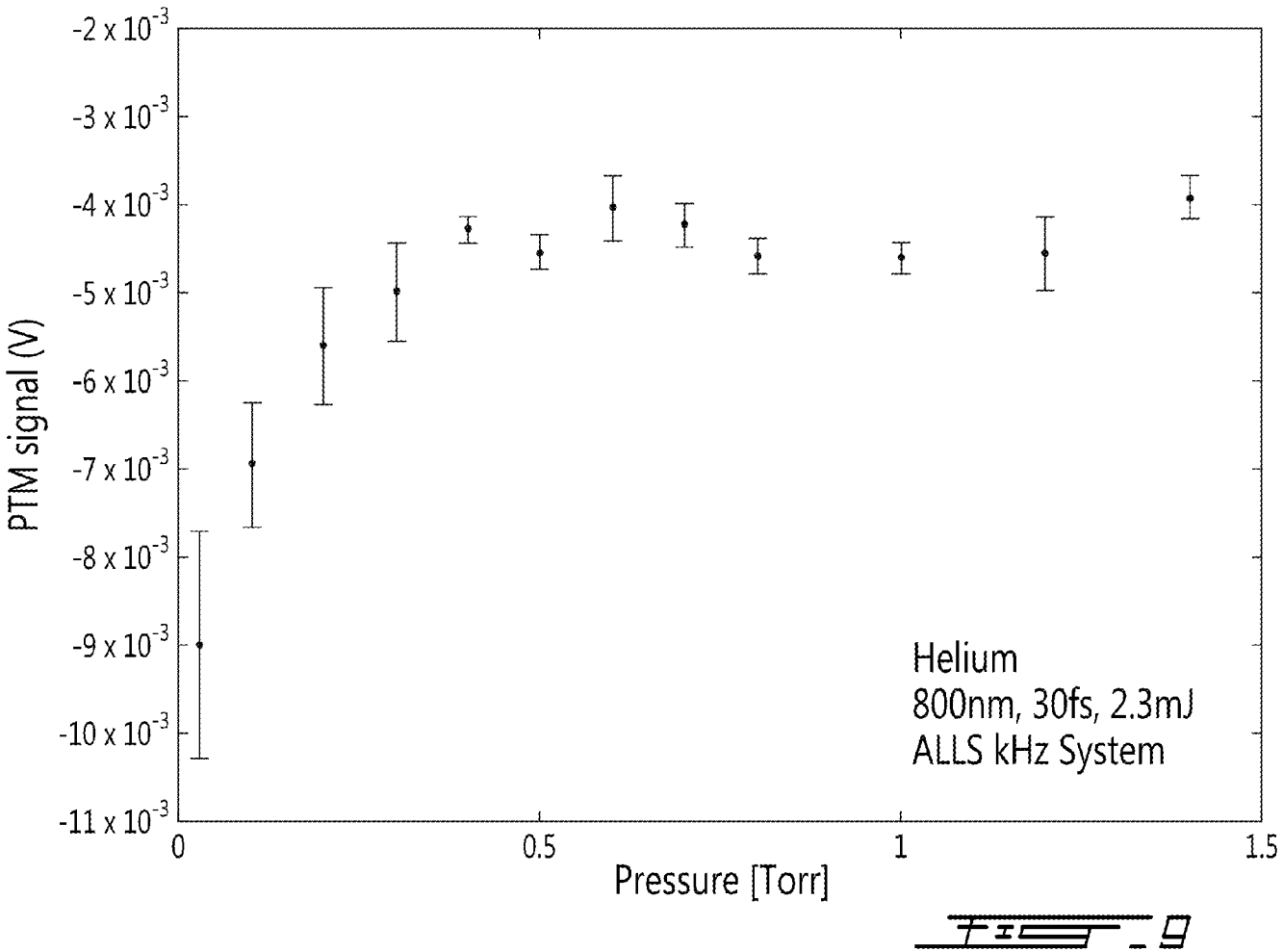
FIG. 9 shows experimental results of the dependence of pressure, with helium, at 800 nm, 30 fs, 2.3 mJ, ALLS kHz system.

FIG. 9 shows the observed electron signal measured by the PMT as a function of helium pressure in the interaction chamber. The laser-matter interaction mechanism is pressure dependent with 2.3 mJ, 30 fs pulses at 800 nm.

Figure 10:
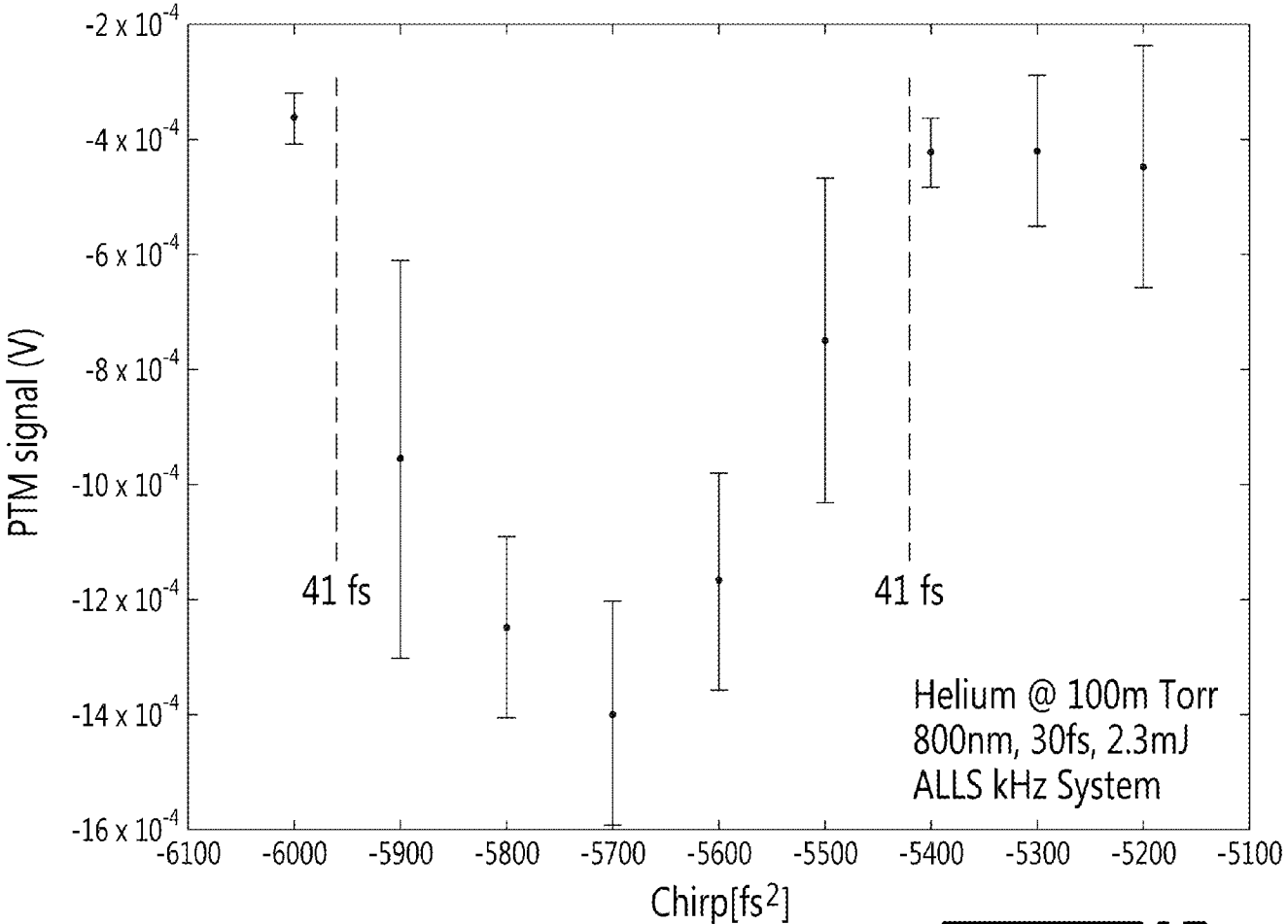
FIG. 10 shows experimental PMT (photo-multiplier tube) signal versus results of the chirped pulse at 800 nm, with Helium at 100 mTorr, 2.3 mJ, ALLS kHz system.

FIG. 10 shows the PMT signal as a function of pulse dispersion of the laser. The laser-matter interaction mechanism is intensity dependent with 2.3 mJ, 30 fs pulses at 800 nm.

It is further observed that the signal of the PMT detector is at least 2 orders of magnitude higher with air than with helium, at 800 nm, due to the difference in electron density, as discussed hereinabove. This indicates that a medium in which electrons have higher ionization threshold than helium can be more effective in generating high current electron beams.

Figure 11:
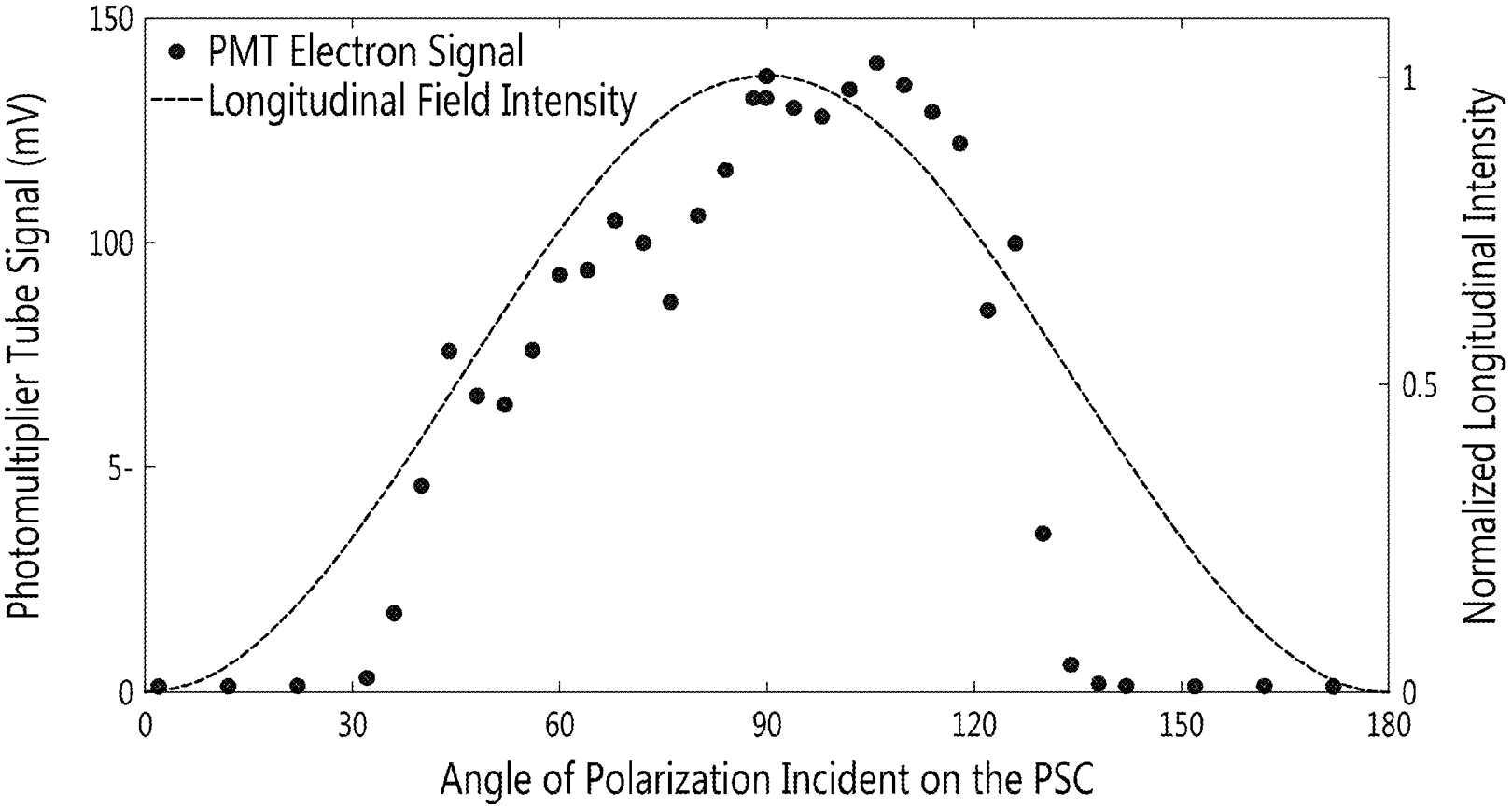
FIG. 11 shows experimental results of the dependence of the signal from the particle detector with respect to the longitudinal field strength at 1.8 μm, with $O_2$ at 800 mTorr, 550 μJ, 15-17 fs.

FIG. 11 shows the observed electron signal measured by the PMT (inverted in the Figure for practical comparison purposes) while shifting from azimuthal ($TE_{01}$ at 0 and 180 deg) polarisation mode with a purely transverse electric field to a radial ($TM_{01}$ at 90 deg) mode with a strong longitudinal electric field. This is consistent with the predicted longitudinal field acceleration scheme, where maximum electron acceleration toward the propagation axis is generated with the $TM_{01}$ mode. No signal was observed when removing the polarization state converter ($TEM_{00}$ mode). The laser-matter interaction described in FIG. 11 was done with a 550 μJ, 15-17 fs pulses at 1.8 μm in 800 mTorr of helium.

Figure 12A:
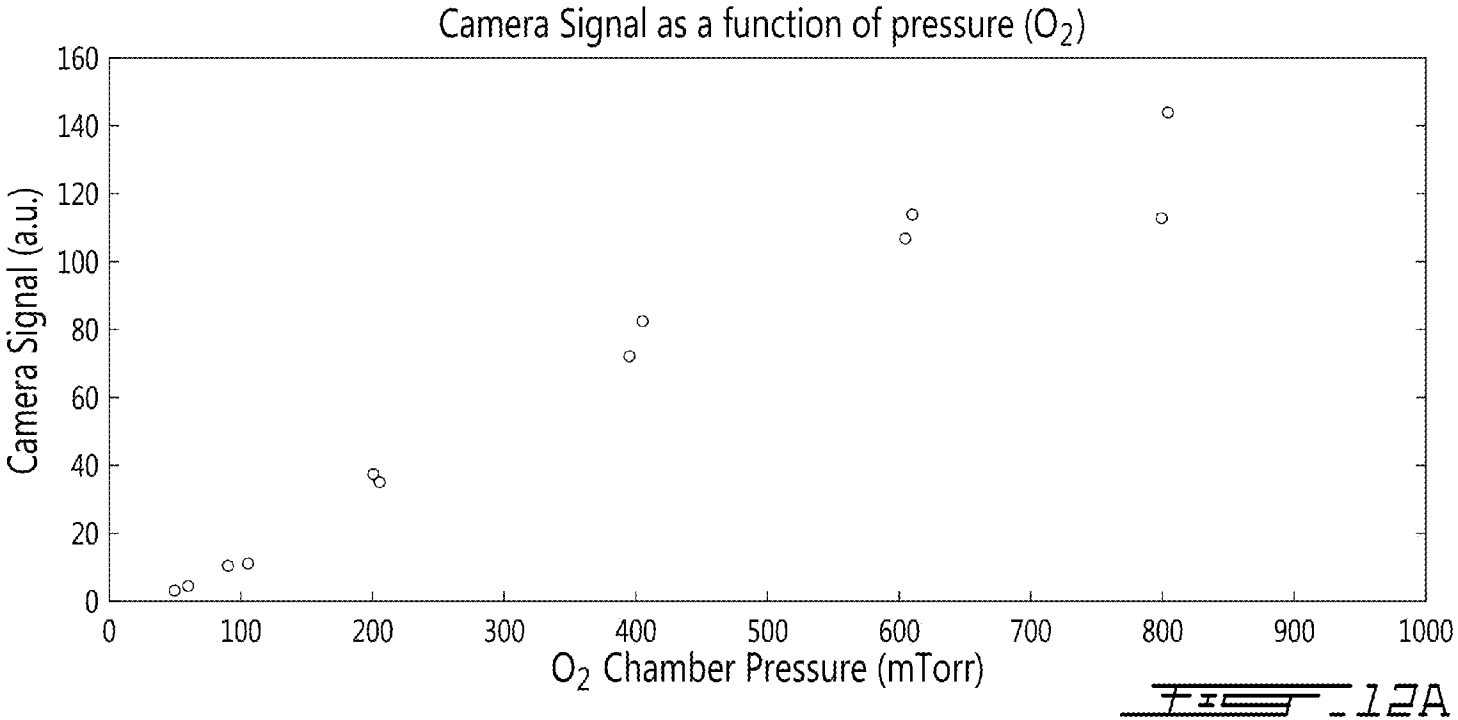
FIGS. 12*a*), 12*b*) and 13 show experimental results of the electron beam signal and profile for different pressures at 1.8 μm, with $O_2$, 550 μJ, 15-17 fs.
Figure 12B:
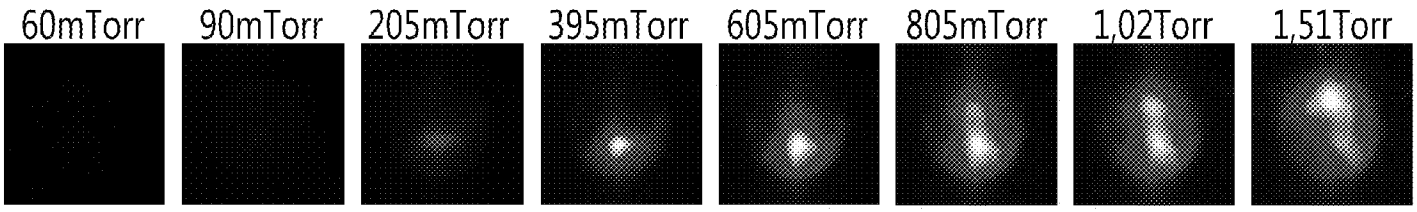
Figure 13:
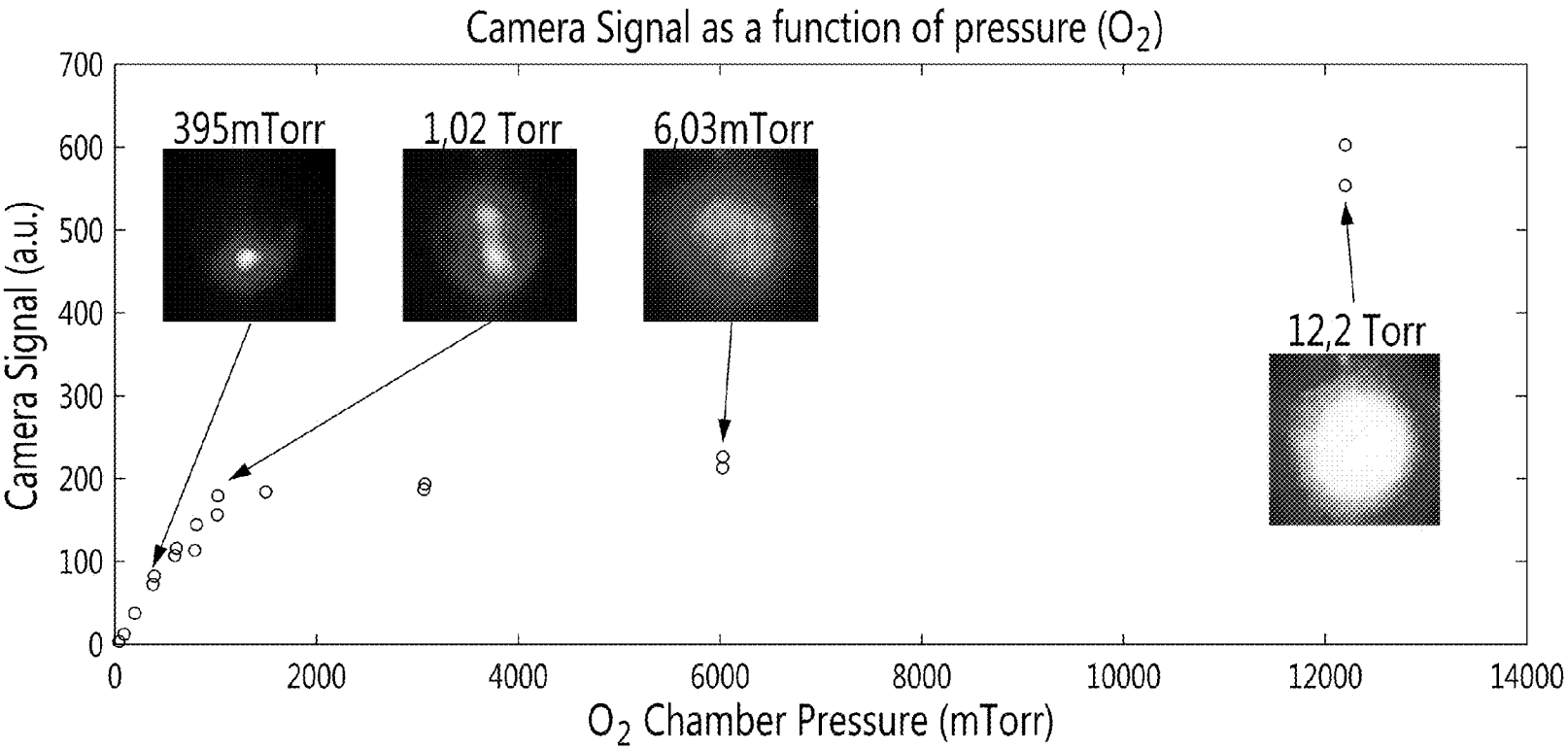
Figure 15:
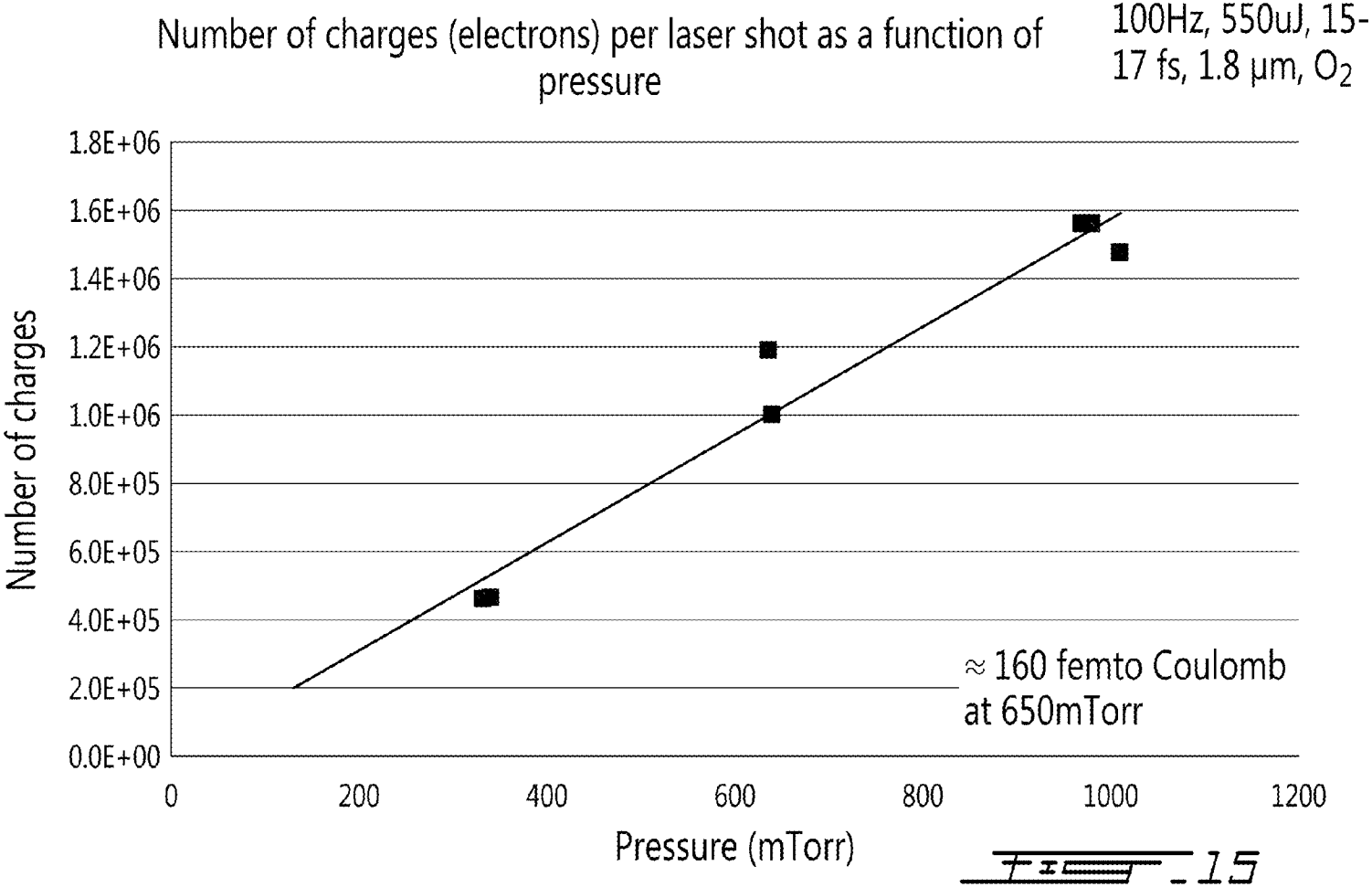
FIG. 15 shows experimental results of the number of charge with respect to pressure of $O_2$ at 1.8 μm, 550 μJ, 15-17 fs.

FIGS. 12 and 13 show the camera electron signal and electron beam profile as a function of pressure in the interaction chamber, over 0-1000 mTorr and 0-14000 mTorr respectively. A beam imaging camera and a faraday cup, coupled to an electrometer, were used to measure the electron bunch charge per shot. Both diagnostics were located on the propagation axis of the electron beam behind mirror M3 (see FIG. 2). The measured values are shown in FIGS. 12, 13 and 15, which indicate a linear dependence of the electron beam current with pressure over 0-1000 mTorr. This would be expected for direct electron acceleration, since the density of electrons in the focal region increases with pressure and each electron is submitted to the same electric field. The apparent distortion of the electron beam profile at higher pressure, seen in FIG. 13, can be related to some non-linear propagation of the laser pulse into the gas filled chamber or to the coupling of the laser pulse with a plasma wave which is plausible at higher pressure.

Figures 14A, 14B, 14C:
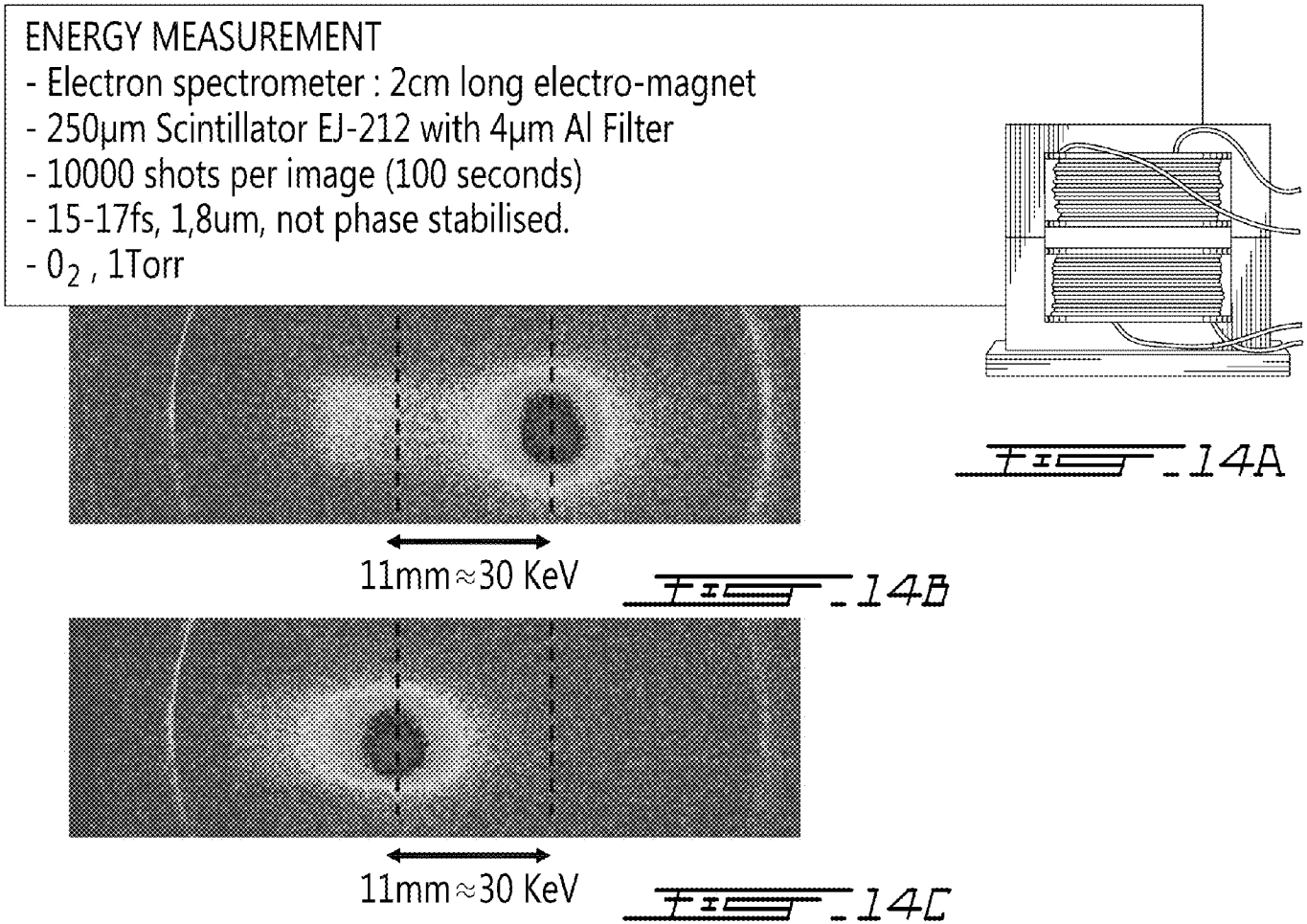
FIG. 14 show experimental results at 1.8 μm, with 1 Torr $O_2$, 550 μJ, 15-17 fs using a) an electro-magnet of the electron spectrometer; b) electron dispersion with the magnetic field at 2 mTesla; c) electron dispersion of the magnetic field at 10 mTesla.

FIGS. 14 *b* and *c* show the energy distribution and intensity profile of the electron beam. The profile of the electron beam was averaged over $10^4$ shots. At a 1 Torr $O_2$ pressure, the mean free path of 20 keV electrons is approximately 15 mm. The divergence of the electron beam, focal point to detector (including probable space charge effects and scattering) is measured to be 37 mrad (half angle at 1/e). The electron energy measurement was made by deflecting the electron beam with the help of a coil producing a magnetic field of 10 mT (FIG. 14*a*). The magnetic field map of the coil has been measured, which allowed to evaluate the electron beam energy to be 23 keV. The energy distribution is quasi-monoenergetic but was not measured finely with a slit. The spread of the energy distribution is estimated to be less than 10% of the mean value of the energy. Electron energy lost from collisions within the interaction chamber is estimated to be 0.02 keV/cm in the 15 to 25 keV range. Therefore, the influence of collisions on the overall structure of the electron spectrum is negligible.

FIG. 15 shows the number of charges (electrons in this case) measured per laser shot. A Faraday cup was used to measure a charge of 1.2 $10^6$ electrons per laser shot. The number of electrons (16 per oxygen molecule) in the focal region, delimited by the transverse maximum peak (0.75 w0) and one Rayleigh length is 1.1 $10^7$. A linear dependence between the charges per shot and the pressure was observed between 50 mTorr and 1 Torr. With this electron density, the space charge effect is expected to be non-negligible. No negative charge was observed with Helium.

In summary, electron beam acceleration by an ultrashort $TM_{01}$ laser beam with a strong longitudinal field was demonstrated. The accelerating longitudinal field was created by tightly focusing a radially polarized ultrashort IR pulse with an on-axis parabola NA 0.7. An electron beam energy of approximately 30 keV was measured, with a divergence of 37 mrad and an average of $10^6$ electrons per shot.

The present method and system can be applicable for time resolved diffraction or imaging with femtosecond resolution and pico-coulomb electron beams. They can also be used with other charged particles, like protons, positrons and ions.

As shown in FIG. 16, the system of the present invention may be configured in such a way to accelerate particles in a cascaded way, providing that the laser is synchronized so that the beam in the focus of focusing optics 18*a* and 18*b* see the acceleration field created. There can thus be provided a two or more acceleration stage system, where at the first focus, the charged particles are accelerated from rest and, in a secondary focus, the same charged particles are re-accelerated to higher energy.

Figure 17:
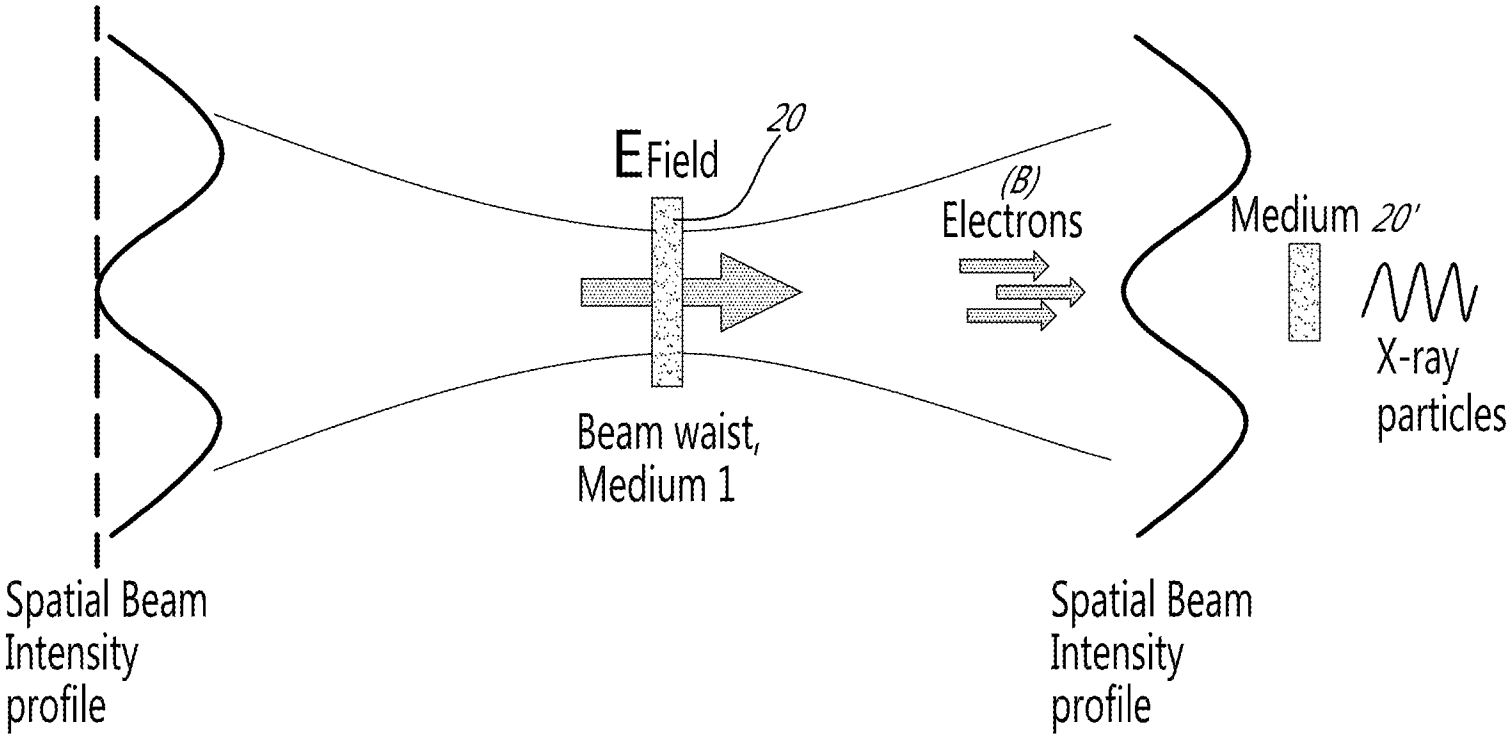
FIG. 17 shows a system according to an embodiment of another aspect of the present invention.
Figure 18:
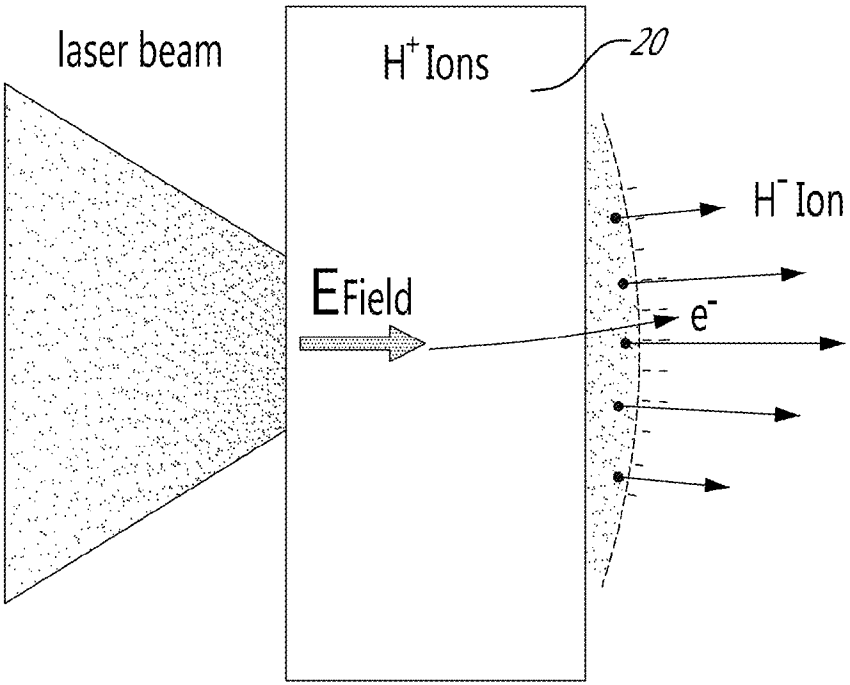

FIG. 17 shows a system according to another embodiment of the invention, to generate charged particle or X-rays in a two mediums configuration. As illustrated in FIG. 17, a second medium 20', such as a thin solid target, a thin film, a liquid, or a high density gas (to create a density difference compared to the gas in the interaction chamber), may be positioned on the propagation axis of the beam, close to the acceleration region, i.e. close to the focal plane, i.e. at a distance of a few microns from the focal plane, so that the particles beam (B) generated in the first medium 20 interact with this second medium 20', without being perturbed by the laser beam, thereby generating X rays or particles sources, for medical applications for example.

Figure 18:
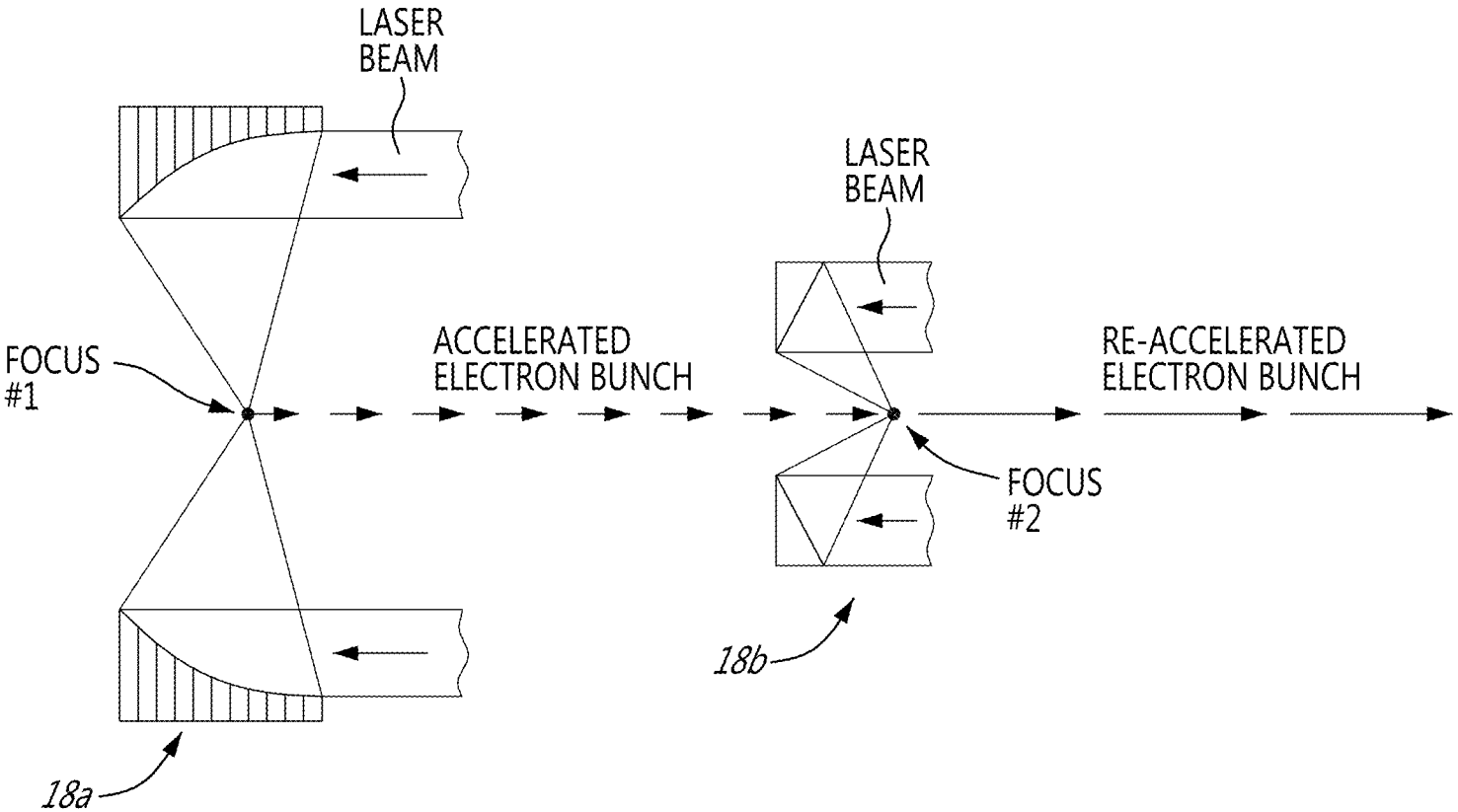
FIG. 18 shows a system according to an embodiment of another aspect of the present invention.

FIG. 18 shows a system according to another embodiment of the invention, to generate a charged particle beam in a two steps acceleration scheme in a same medium, including a first acceleration step of electrons as described hereinabove in relation to FIGS. 1 and 2 for example, and a second acceleration step occurring as, upon expulsion of the electrons from the medium 20, the electrons create a high electrical field due to charge separation, which results in acceleration of protons and ions of the target, using the same medium 20.

Thus, the present system and method may be used for target normal sheath acceleration (TNSA), by a two-step acceleration using the same medium 20 as discussed in relation to FIG. 18, or two media as discussed in relation to FIG. 17.

As people in the art will now be in a position to appreciate, there is provided a method and a system to generate a high intensity field, using any type of laser pulse, with a minimum laser power. The present method and system may use a range of lasers, including fiber lasers and ultrashort pulse lasers.

There is provided an all-optical method and system to generate ultrashort, i.e. picoseconds, femtosecond, attosecond, charged particle, such as electrons, positrons, protons and ions, beams. The generated particle beams can have a mono-energetic distribution and a low divergence.

The present method and system allow the generated electron beam to interact with a sample or medium in such a way that the electron beam has to propagate a short distance, as the sample or the medium can be positioned extremely close to the acceleration region, as close as a few micrometers for example, depending on the shaping and focusing parameters. This allows for a minimum space charge effect to occur in the generated charged particle beam. The present method and system allow the sample or medium, which can thus be positioned close to the acceleration region, to be unperturbed by the laser pulse while interacting with the electron beam.

As people in the art will appreciate, the present system does not use a cathode to anode configuration. Moreover, it is easily tunable in energy, and could be adapted to time resolved electron imaging/diffraction.

The present method and system provide creating an optimal longitudinal field for generation of low-divergence, monoenergetic (linearly distributed phase-space), ultrashort, i.e. picosecond, femtosecond and attosecond), charged particle, i.e. electrons, positrons or protons, bunches.

Although the present invention has been described hereinabove by way of embodiments thereof, it may be modified, without departing from the nature and teachings of the subject invention as described herein.

The invention claimed is:

1. A method for generating an ultrashort charged particle beam, comprising creating a high intensity longitudinal E-field by shaping and tightly focusing in an on-axis geometry a substantially radially polarized laser beam, and using the high intensity longitudinal E-field for interaction with a medium to accelerate charged particles.

2. The method of claim 1, comprising a) converting the polarization of a beam from a high peak power laser to a substantially radial polarization, b) shaping and optimizing the intensity profile and wavefront of the beam; c) tight focusing the radially polarized laser beam in an on-axis geometry with a high numerical aperture optic; and d) accelerating charged particles from the medium by the resulting high intensity longitudinal E-field; in an interaction chamber.

3. The method of claim 1, comprising focusing the radially polarized beam so that radial field projections cancel themselves transversally and align themselves longitudinally, in such a way that a longitudinal to transverse field ratio (LTFR) in the focal plane is maximum for an ultrashort pulse, with the LTFR ratio defined as follows:

$$LTFR = \frac{\text{Longitudinal Field intensity}}{\text{Transverse Field intensity}}.$$

4. A system for generating an ultrashort charged particle beam, in an interaction chamber, comprising:

a laser system delivering an ultrashort pulse;

a polarization converter unit converting a beam from said laser system into a substantially radially polarized laser beam;

amplitude beam shaping and transport optics, shaping the substantially radially polarized laser beam;

focusing optics tight-focusing the beam received from said transport optics in an on-axis geometry; and a first medium from which charged particles are accelerated by the tight-focused beam.

5. The system of claim 4, wherein said laser system provides ultrashort laser pulses.

6. The system of claim 4, wherein said polarization converter comprises one of: achromatic half wave plates; electro optical modulators, Z-polarization plates, mode polarization combinators and fiber optics.

7. The system of claim 4, wherein said amplitude beam shaping optics comprise at least one of: reflectivity mirrors, hole mirrors, amplitude masks, a diffraction elements, axicons and fiber optics.

8. The system of claim 4, wherein said amplitude beam shaping optics comprise at least one of: reflectivity mirrors, hole mirrors, amplitude masks, a diffraction elements, axicons and fiber optics, in combination with a deformable mirror.

9. The system of claim 4, wherein said focusing optics comprise high numerical aperture optics compatible with ultrashort pulses.

10. The system of claim 4, wherein said focusing optics comprise optics of numerical aperture of at least 0.5, compatible with ultrashort pulses.

11. The system of claim 4, wherein said focusing optics comprise a parabolic mirror in an on axis-geometry, with one of: i) a focal point position near or at the edge of the parabolic mirror; ii) a focal point inside the parabolic mirror and iii) a focal point through a partially cut parabolic mirror.

12. The system of claim 4, wherein said focusing optics comprise a parabolic mirror in an on axis-geometry, with one of: i) a focal point position near or at the edge of the parabolic mirror; ii) a focal point inside the parabolic mirror and iii) a focal point through a partially cut parabolic mirror, in combination with a deformable mirror.

13. The system of claim 4, wherein said focusing optics comprise one of: i) a microscopic objective and ii) a parabola.

14. The system of claim 4, wherein said focusing optics comprise one of: i) a microscopic objective in combination with an ellipsoid and ii) a parabola in combination with an ellipsoid.

15. The system of claim 4, wherein said focusing optics comprise one of: i) a microscopic objective and ii) a parabola, in combination with a deformable mirror.

16. The system of claim 4, wherein said interaction chamber is filled with a low density gas under controlled pressure.

17. The system of claim 4, wherein said interaction chamber is filled with one of helium, oxygen and argon, under controlled pressure.

18. The system of claim 4, wherein said first medium is one of a gas, a liquid, a solid, and a plasma.

19. The system of claim 4, further comprising a second medium located on the propagation axis of the ultrashort charged particle beam, positioned close to the acceleration region, for interaction with the ultrashort charged particle beam.

20. The system of claim 4, further comprising a second medium located on the propagation axis of the ultrashort charged particle beam, positioned close to the acceleration region, for interaction with the ultrashort charged particle beam, said second medium being one of a thin solid target, a thin film, a liquid and a high density gas.

21. A method, comprising:

a) radially polarizing, shaping and optimizing a high peak power laser pulse; and b) tight focusing the radially polarized pulse in an on-axis geometry, in a low pressure gas environment, thereby generating a high intensity longitudinal E-field.

22. The method of claim 21, further comprising accelerating charged particles of a first medium with the high intensity longitudinal E-field.

23. The method of claim 21, further comprising accelerating charged particles of a first medium with the high intensity longitudinal E-field into an ultrashort charged particle beam and interacting the ultrashort charged particle beam with a second medium located on the propagation axis of the ultrashort charged particle beam, positioned close to the acceleration region.

24. The method of claim 21, further comprising using the high intensity longitudinal E-field for interaction with a medium composed of electrons, protons and ions to accelerate electrons in the propagation axis, thereby creating a space charge field that accelerates protons and ions from the medium.

25. The method of claim 21, further comprising accelerating charged particles of a first medium with the high intensity longitudinal E-field into an ultrashort charged particle beam and interacting the ultrashort charged particle beam with a second medium composed of electrons, protons and ions, located on the propagation axis of the ultrashort charged particle beam, positioned close to the acceleration region, thereby accelerating protons and ions from the second medium.

26. A method for generating X ray or particles sources, comprising creating a high intensity longitudinal E-field by tightly focusing a radially polarized laser beam in an on-axis geometry, using the high intensity longitudinal E-field for interaction with a first medium to accelerate charged particles and generate an ultrashort charged particle beam, and interacting the ultrashort charged particle beam with a second medium located close to the acceleration region.

* * * * *